United States Patent [19]

Kitchen

[11] Patent Number: 4,825,800

[45] Date of Patent: May 2, 1989

[54] MARINE HORN INSTALLATION

[75] Inventor: John C. Kitchen, Walnut Creek, Calif.

[73] Assignee: American Foreign Industries, Inc., Pittsburg, Calif.

[21] Appl. No.: 154,072

[22] Filed: Feb. 9, 1988

[51] Int. Cl.[4] ..... G08B 07/00; G10K 01/38

[52] U.S. Cl. ..... 116/4; 116/137 R; 181/19; 181/148; 446/204

[58] Field of Search ..... 116/137 R, 19, 24, 58, 116/142 FP; 340/388, 984, 88; D10/120; 181/19, 141

[56] References Cited

U.S. PATENT DOCUMENTS

| | | | |
|---|---|---|---|
| 1,698,804 | 1/1929 | Sparks | D10/120 |
| 1,874,078 | 8/1932 | Aupiero | 116/142 R |
| 2,166,821 | 7/1939 | Nielsen | 116/137 R |
| 2,689,543 | 9/1954 | Lemmon | 116/137 R |
| 3,124,098 | 3/1964 | Thoben | 116/142 R |
| 3,906,490 | 9/1975 | Shaw | 340/388 |
| 4,281,224 | 7/1981 | Castagna | 181/150 X |
| 4,625,829 | 12/1986 | Sirois | 181/150 X |
| 4,710,749 | 12/1987 | Berke et al. | 340/388 X |

*Primary Examiner*—Daniel M. Yasich

*Attorney, Agent, or Firm*—Owen, Wickersham & Erickson

[57] ABSTRACT

A horn assembly for installation within an opening in a boat structure having an exterior surface and an interior surface, is disclosed. The horn assembly includes a noise generator component whose output is directed through a trumpet member having an inlet section and an outlet section. A flared element adapted to extend through the opening in the boat structure has an inner end connected to the trumpet member and an outer end with a peripheral flange that bears against the exterior surface surrounding the opening. A grille element extends over and secures the flared element and thus the horn assembly to the boat structure leaving only the grille element visible on the boat exterior.

6 Claims, 2 Drawing Sheets

FIG._5.
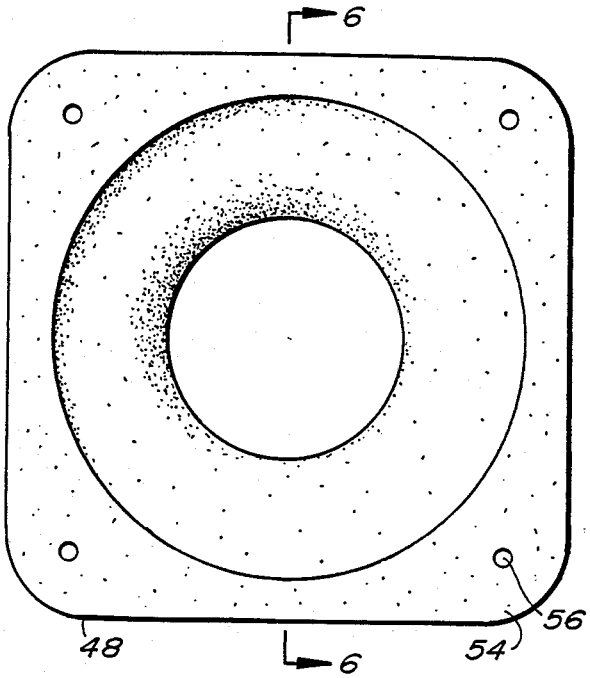
FIG._7.
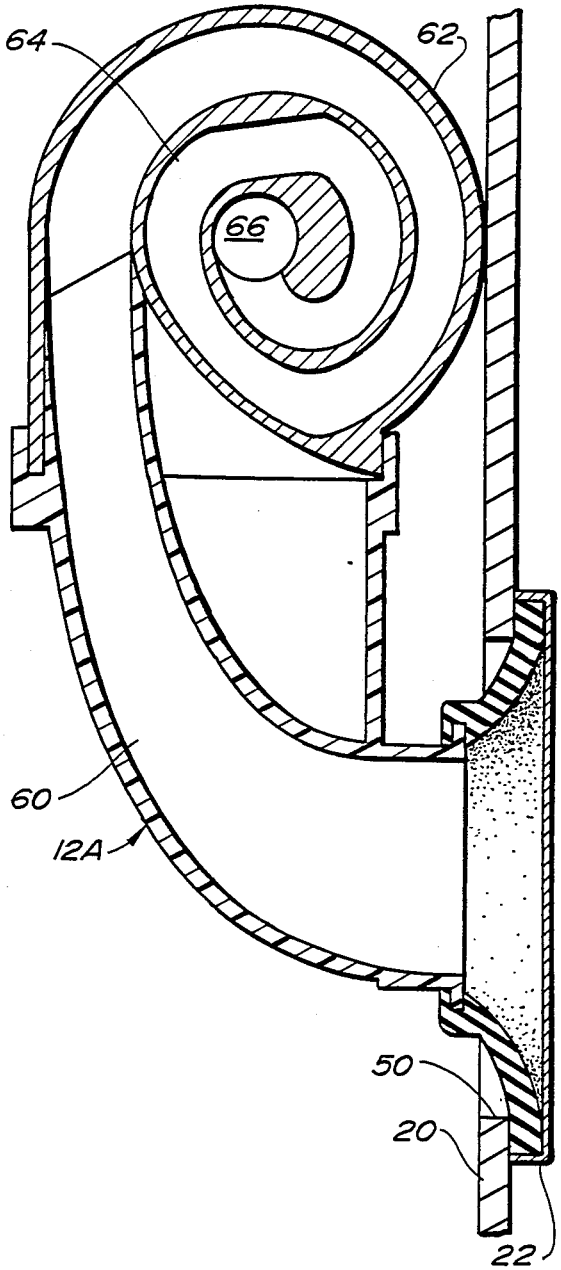
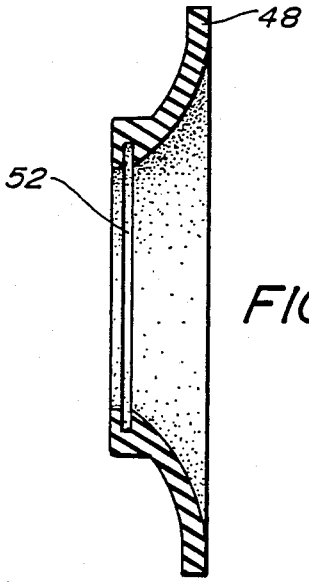
FIG._6.

MARINE HORN INSTALLATION

SPECIFICATION

This invention relates to an improved horn installation particularly adapted for small marine craft.

BACKGROUND OF THE INVENTION

As with most passenger carrying vehicles, a horn is an essential accessory on all boats that must operate in congested waterways and marinas. Heretofore, most horns were attached to an exterior portion of a boat structure using a suitable bracket or mounting device in order for the horn output to be unobstructed. Usually, this meant that the horn itself projected outside the general exterior shape of the boat's cabin configuration, which resulted in an arrangement lacking aesthetic design appeal. Also, the prior methods for mounting horns on boats by merely attaching them to exterior structure made them vulnerable to impact damage as well as degradation due to weather conditions.

It is therefore the general object of the present invention to provide an improved horn mounting system for small boats: that is relatively easy to install with a minimum of labor and materials; that provides an unobstructed location of the horn output end on an exterior boat surface; and thus a mounting system that is aesthetically pleasing with respect to surrounding boat structure.

A more specific object of the invention is to provide a horn mounting system for boats that enables the operating horn mechanism to be located inside a boat structure with the outlet end of the horn located substantially flush with an exterior surface of the boat structure.

SUMMARY OF THE INVENTION

In accordance with the principles of the invention a marine horn is provided which is comprised of a noise generator component and a sound projecting trumpet member which are interconnected by a tubing member. The noise generator may be fixed to or retained near the interior surface of a relatively thin wall of boat structure. Spaced from the noise generator at a preselected location is an opening through the boat structure within which is mounted a flared sealing member of elastomeric material which is connected to the trumpet member of the horn. The flared sealing member of the trumpet member extends through the opening and is covered by a grille member that secures it to the exterior surface surrounding the opening. Thus, the outlet of the horn is unobstructed and provides a substantially flush installation on the boat exterior while being fully controllable from inside the boat.

Other objects, advantages and features of the invention will become apparent from the following detailed description of one embodiment thereof, presented in conjunction with the accompanying drawing.

BRIEF DESCRIPTION OF THE DRAWING

FIG. 5 is a front view of the sealing member for the horn of FIGS. 1–3.

FIG. 6 is a view in section taken along 6—6 of FIG. 5.

FIG. 7 is a view in elevation and in section showing a modified form of horn utilizing principles of the present invention.

DETAILED DESCRIPTION OF EMBODIMENT

Figure 1:
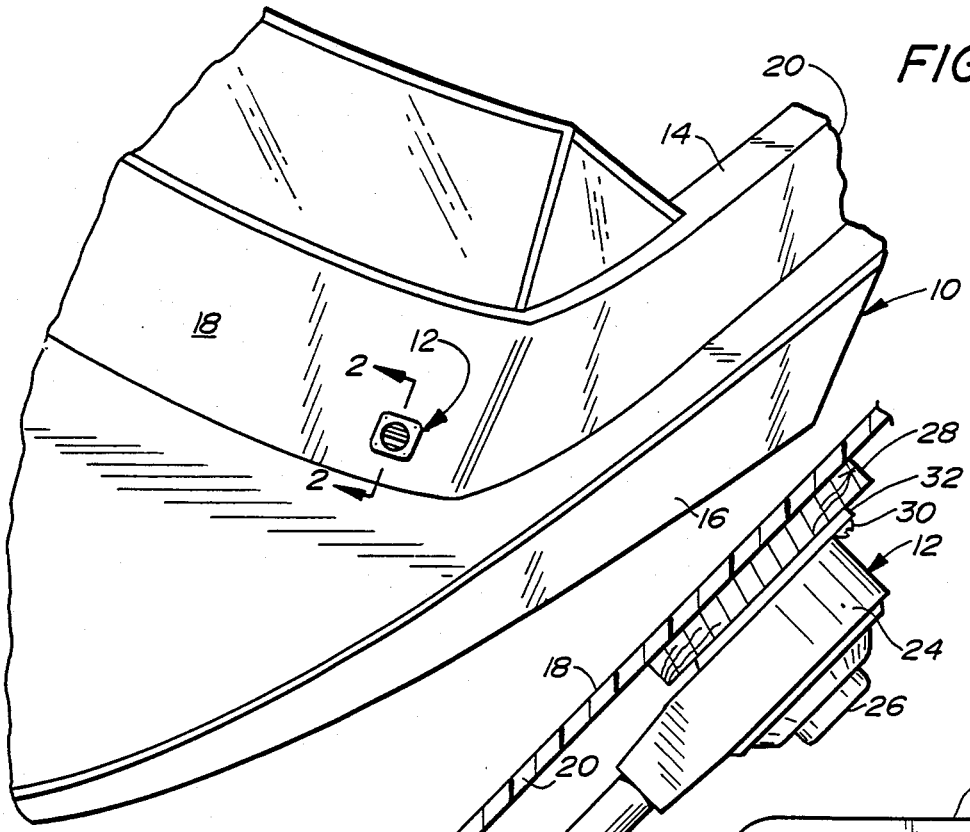
FIG. 1 is a fragmentary view in perspective of a boat utilizing a horn installation system according to the present invention.

With reference to the drawing, FIG. 1 shows a typical small boat 10 that is equipped with a marine horn 12 according to the present invention. The boat is shown as being representative of a typical small marine craft having a raised deck or bridge section 14 extending above its hull 16 that forms a control area for the pilot. The bridge section typically has a smooth exterior surface 18 formed by a structural sheet member 20 of substantially uniform thickness. In accordance with the invention, as shown in the enlarged FIG. 2, the marine horn 12 is mounted so that its outlet end, covered by a grille 22, from which the horn sounds are projected, is substantially flush with the smooth exterior boat surface 18. Yet, the principle components of the horn are situated on the inside of the sheet member.

Figure 2:
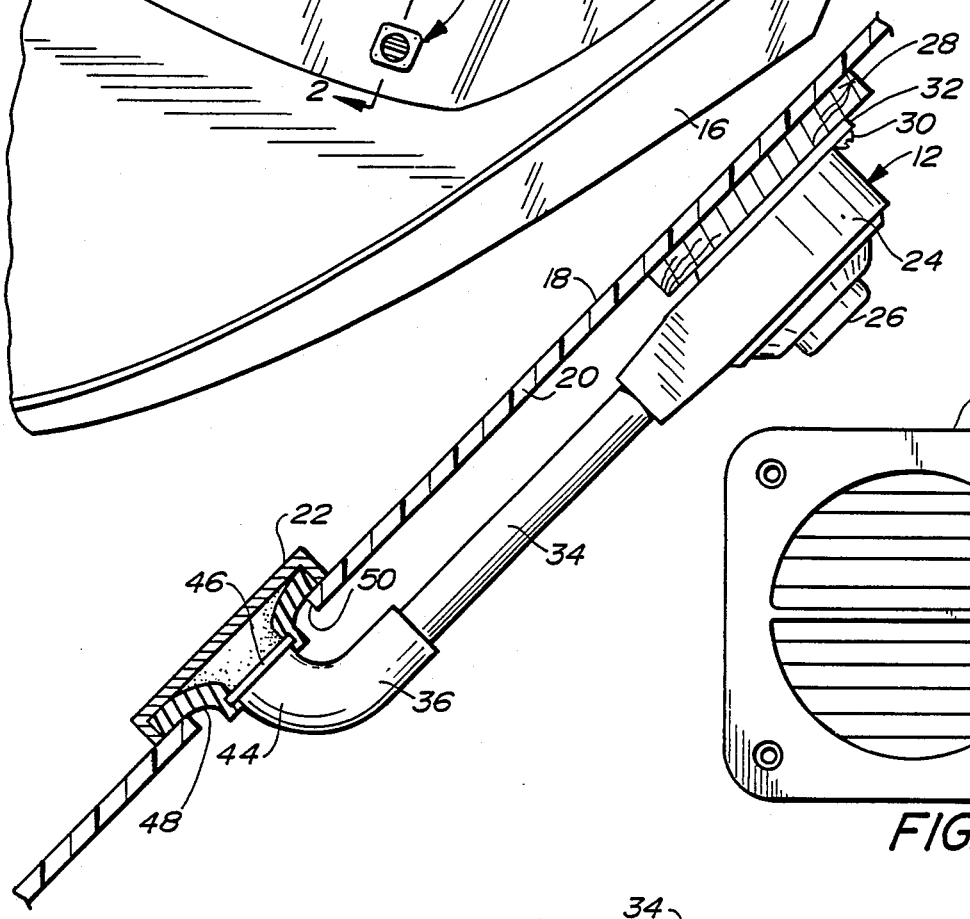
FIG. 2 is an enlarged view in section taken along line 2—2 of FIG. 1 showing the horn installation in greater detail.

As shown in FIG. 2, the horn 12 is comprised of a sound generator 24 of the conventional type preferably powered by a battery, not shown. An exterior, manually operated button 26 may be provided on the generator to activate the horn or at some other convenient location remote from the horn. The sound generator may be fixed to a mounting block 28 on the inside surface of the sheet member 20 which is normally fixed thereto by fasteners 30 such as screws that extend through a base portion 32 of the sound generator. The sound generator is connected by a short section of tubing 34 to a trumpet member 36 at the opposite end of the horn. The trumpet member has a passageway that forms an angle of 90° with the tubing section 34 and thus provides a change of direction for sound waves passing through the tubing 34, as well as being divergent in shape to provide optional sound propagation.

Figure 3:
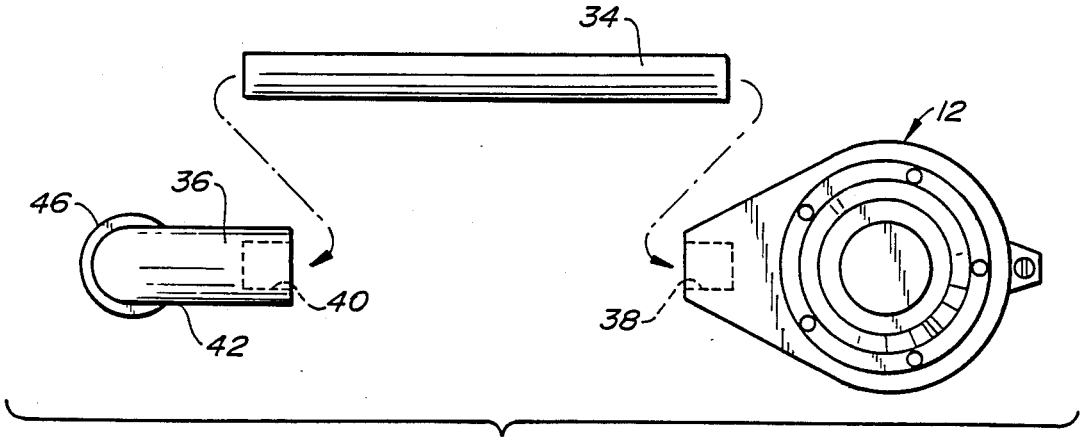
FIG. 3 is an expanded plan view showing components of the horn assembly illustrated in FIG. 2.

As shown in FIG. 3, the sound generator 24 has a cylindrical recess 38 at one end, and the trumpet member 36 has a similar recess 40 in an inlet portion 42 thereof, both of said recesses being adapted to receive the opposite ends of the tubing section 34 with an sliding fit.

An enlarged circular end 44 of the trumpet member is surrounded by an outwardly extending integral flange 46 which enables the trumpet member- to connect with a flared end member 48. As shown in FIG. 2, the flared end member 48 extends through an opening 50 that is provided in the sheet member 20 of the boat.

Figure 4:
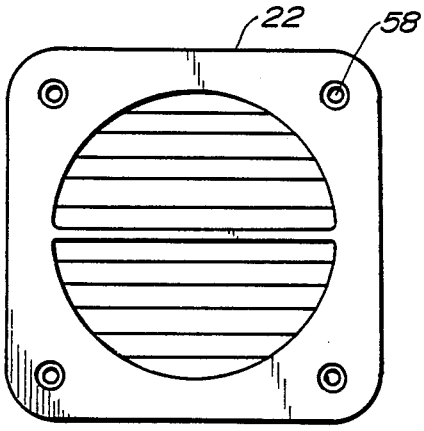
FIG. 4 is an enlarged view front view of the grille covering for the trumpet end of the horn shown in FIG. 2.

Structural details of the flared member 48 are best shown in FIGS. 5 and 6. Preferably it is molded as a single component from a fairly hard but somewhat flexible rubber-like material. At its smaller inner end it has a circular inner groove 52 which is sized to receive the end flange 46 on the circular end 44 of the trumpet member 36. At the larger circular end of the flared member, which extends outside of the structural sheet member, 20, the flared member has an outwardly extending integral flange portion 54 of uniform thickness. The outer edge of this flange portion may have a square, rectangular or any desired configuration, and in the embodiment shown, fastener holes 56 are provided at the far corners of the flange portion 54. In a typical installation, as shown in FIG. 2, the flange portion 54 of the flared member 48 provides a continuous elastomeric sealing member that assures a water tight seal for the horn around the opening 50. Extending over the flange 46 and around its edges, as shown in FIGS. 2 and 4, is the outer grille 22 which is secured to the boat sheet structure 20 by a series of suitable fasteners 58 that pass through the holes 56 of the flared member to boat structure. The grille provides a plurality of openings for sound waves from the trumpet member, and such grille openings can be formed in a variety of configurations.

On most marine craft, the horn 12 can be quickly and easily installed at some convenient location wherever a structural sheet of material is present to provide an exterior surface and an interior surface. For the embodiment in FIGS. 1–3, the sound generator 24 is first installed on the mounting block 28 which is fixed to the inside surface of the structural sheet member. The opening 50 for the flared end member 48 of the horn is now cut through the structural sheet member 20 at an appropriate location spaced from the horn generator 24. With the flared member extending through the opening the trumpet member 36 may now be attached to the flared, member and to the tubing section 34. The outer grille 22 is now placed over the outer end of the flared member 46 and is secured to the exterior surface of the structural sheet member by the fasteners 58.

Another horn embodiment 12A that utilizes principles of the invention, is shown in FIG. 7. Here, the flared member again extends through an opening 50 in the boat structure and is secured thereto by fasteners that extend through the outer grille and the flange of the flared member. Here, the inner end of the flared member is attached to a rigid adapter 60, preferably formed from a suitable plastic material, which is connected directly to a sound generator 62 at its other end. In this case the sound generator may be of the so-called spiral or "conch" type having a generally helical passage 64 which extends in a spiral path from the generator source 66 to an outer end which is connected to the adapter. Here, the adapter 60 is large enough and strong enough to fully support the sound generator 62 so that the latter does not need any mounting or support means connecting it to the inside surface of boat structure.

Once installed, either marine horn 12 or 12A presents only its outlet grille 22 to the boat exterior, as shown in FIGS. 1 and 7, and this grille is preferably substantially flush with the exterior boat surface. Thus, the invention provides for a marine horn 12 with an unobstructed outlet having excellent acoustic properties and yet one that does not project outwardly and thus has little or no affect on the exterior shape of the boat. Moreover, with the horn mechanism retained on the inside of the boat structure, it is well protected from weather effects, and is easily accessible for use when needed.

To those skilled in the art to which this invention relates, many changes in construction and widely differing embodiments and applications of the invention will suggest themselves without departing from the spirit and scope of the invention. The disclosures and the descriptions herein are purely illustrative and are not intended to be in any sense limiting.

What is claimed is:

1. A horn assembly for installation on a boat structure having an exterior surface and an interior surface, with an opening through said structure, said horn assembly comprising:

a noise generator component;

a trumpet member having an inlet section and an enlarged outlet section;

a flared element adapted to extend through said opening in said structured and having a small inner end connected to an integral end portion of said enlarged outlet section of said trumpet member said flared element having an outer and with peripheral flange means;

means interconnecting said noise generator component and said inlet section of said trumpet member; and grille means for covering said peripheral flange means and fastener means extending through said grille means and said flange means, thereby securing said outer end of said flared element to the exterior surface of said boat structure surrounding said opening while retaining the outer components of said horn assembly on the interior surface of the boat structure.

2. The horn assembly as described in claim 1 wherein said interconnecting means between said noise generator and said trumpet member comprises a tubular means for securing said noise generator component to said interior surface.

3. The horn assembly as described in claim 1 wherein said flared element has a generally frusto conical shape and is formed in one piece from elastomeric material thereby forming a liquid seal around said opening.

4. The horn assembly as described in claim 1 wherein said flange means of said flared element has a generally rectangular shape with holes near its four corners adapted to receive fastener means for securing it against said exterior boat surface.

5. The horn assembly as described in claim 1 wherein said flared element has a peripheral groove around its inner end adapted to receive a peripheral flange on the outer end section of said trumpet member.

6. The horn assembly as described in claim 1 wherein said noise generator includes a housing forming a spiral air passage and said interconnecting means comprises an adapter member connected to an outer end of said spiral passage and also to said inner end of said flared element.

* * * * *

UNITED STATES PATENT AND TRADEMARK OFFICE

CERTIFICATE OF CORRECTION

PATENT NO. : 4,825,800

DATED : May 2, 1989

INVENTOR(S) : John C. Kitchen

It is certified that error appears in the above-identified patent and that said Letters Patent is hereby corrected as shown below:

Column 4, line 17, "structured" should read --structure-- line 20, "and" should read --end-- line 30, "outer" should read --other--.

Signed and Sealed this

Seventeenth Day of April, 1990

*Attest:*

HARRY F. MANBECK, JR.

*Attesting Officer*

*Commissioner of Patents and Trademarks*